US006872448B2

(12) United States Patent
Sanders

(10) Patent No.: US 6,872,448 B2
(45) Date of Patent: Mar. 29, 2005

(54) SPLICE BETWEEN TWO ENDS OF YARN

(76) Inventor: Falk-Hayo Sanders, Aussichtsstr. 6, Herrliberg (CH), 8704

( * ) Notice: Subject to any disclaimer, the term of this patent is extended or adjusted under 35 U.S.C. 154(b) by 0 days.

(21) Appl. No.: 10/486,718

(22) PCT Filed: Aug. 16, 2002

(86) PCT No.: PCT/EP02/09187

§ 371 (c)(1),
(2), (4) Date: Mar. 2, 2004

(87) PCT Pub. No.: WO03/016190

PCT Pub. Date: Feb. 27, 2003

(65) Prior Publication Data

US 2004/0200047 A1 Oct. 14, 2004

(30) Foreign Application Priority Data

Aug. 17, 2001 (DE) ..... 101 40 488

(51) Int. Cl.[7] ..... D01F 6/00; D02G 3/00; D01H 11/00; B65H 69/02

(52) U.S. Cl. ..... 428/364; 156/158; 51/202; 51/261

(58) Field of Search ..... 428/364; 156/158; 57/202, 261

(56) References Cited

U.S. PATENT DOCUMENTS

| | | | | |
|---|---|---|---|---|
| 2,298,676 A | | 10/1942 | Camp | 28/1 |
| 2,537,007 A | | 1/1951 | Abbot, Jr. | 28/47 |
| 2,808,356 A | | 10/1957 | Kimball | 154/53.6 |
| 3,161,941 A | | 12/1964 | John | 28/72.5 |
| 3,810,802 A | * | 5/1974 | Buhite | 156/158 |
| 4,662,962 A | | 5/1987 | Malavieille | 156/158 |

FOREIGN PATENT DOCUMENTS

| | | |
|---|---|---|
| DE | 2 035 369 | 7/1970 |
| FR | 1.544.843 | 11/1968 |
| FR | 2.231.264 | 12/1974 |

* cited by examiner

*Primary Examiner*—N. Edwards
(74) *Attorney, Agent, or Firm*—Parkhurst & Wendel, L.L.P.

(57) ABSTRACT

The invention relates to a splice between two ends of yarn, the ends of yarn, positioned to point at each other without increase in diameter, each being joined over a length of yarn to at least one longitudinal strip. The longitudinal strip is provided on its side facing the ends of yarn with a joining agent, said joining agent permanently binding the ends of yarn over the respective length of yarn to the longitudinal strip in frictional non-positive manner.

13 Claims, 3 Drawing Sheets

SPLICE BETWEEN TWO ENDS OF YARN

BACKGROUND OF THE INVENTION

The invention relates to a splice between two ends of yarn as required, for example, when, in the continuous processing of a yarn which is being unwound from one yarn spool, the end of the yarn is reached and it becomes necessary for the starting part of the yarn supplied from another yarn spool to be spliced to the end. Such an operation takes place, in particular, when there is a change of warp beams in weaving machines, when the yarn wound onto one warp beam reaches its end and it becomes necessary for the starting part of the corresponding yarn from a new warp beam to be spliced to the aforementioned end, there resulting a multiplicity of such splices across the width of the warp beam.

The conventional method, employed in connection with the above-described applications, of splicing the end of one yarn to the starting part of another yarn consists in the operation of tying, as described, for example, in DE OS 17 10 938. According to this publication, the starting part and end are held by clamping and are then subjected to a tying operation which is performed by a complicated mechanism. A further known method of splicing consists, according to DE OS 32 47 162, in coaxially aligning the yarns with respect to each other with a small distance between them and in holding them in this position using clamping devices, whereupon a bonding agent is introduced in dosed droplet form into the gap between starting part and end of the yarn, with rollers acting on the place of bonding and rotating said place of bonding in order, at the place of bonding, to obtain a diameter equal to the diameter of the overall yarn.

The method of mechanically tying together the starting part and end of the yarns results in a considerable degree of mechanical complexity with corresponding intensity of maintenance. Furthermore, there is a considerable increase in the diameter of the yarn at the place of tying, this making it impossible in many applications for the yarn to be continuously processed, because, in a weaving machine, for example, the yarn has to run through harnesses and the weaving comb. When the weaving comb is operated, it is moved very closely past the yarn at high speed, wherein a place of tying is exposed to quite considerable frictional and tensile stresses, which may result in the yarn tearing at the place of tying. The continuous processing of tied yarns on weaving machines is, therefore, impossible at present. For this reason, when use is made of the presently conventional method of mechanical tying, an attempt is made to employ the maximum possible lengths of yarns on the warp beams in order in this manner to save on the effort of individually tying all the yarns on the warp beam, something which is associated with a considerable expenditure of time. The consequence of this is that small lot sizes, which would be economically advantageous for relatively short lengths of woven goods, are virtually never produced, because this would necessitate correspondingly shorter lengths of yarn on the warp beams. The additionally known method of introducing a droplet of bonding agent into the gap between the starting part and end of a clamped yarn is virtually never used because, particularly in the case of thin yarns, there is a correspondingly small bonding zone which is not capable of withstanding a high tensile stress during the processing of the yarn and which, therefore, has a tendency to tear.

Known from EP 0 989 218 A1 is a further method of splicing an end of yarn to a starting part of yarn according to which the end and the starting part are firmly held in a position in which they overlap over a considerable length and are twisted together in that position. In order to provide this twisted region with the necessary tensile strength and resistance to reverse twisting, a bonding agent is dabbed onto the twisted region. This method, therefore, comprises two successive process steps, it being necessary first of all for the intertwisted yarns to be firmly held in said position until the bonding agent, having been dabbed onto the twisted region, has set. This slows down the process so considerably that it has not been able to establish itself in practice. It must also be taken into consideration in this connection that the twisted yarns have the tendency to twist back, as a consequence of which the splice is from the outset given the tendency automatically to become undone unless the bonding agent joins the two yarns together really firmly.

BRIEF SUMMARY OF THE INVENTION

The object of the invention is to create a splice between two ends of yarn, said splice being capable of withstanding considerable frictional and tensile stresses and additionally leading to only insignificant thickening at the place of the splice. The object of the invention is achieved in that the ends of yarn, positioned to point at each other without increase in diameter, are each joined over a length of yarn to at least one longitudinal strip, said longitudinal strip being provided on its side facing the yarns with a joining agent, said joining agent permanently binding the ends of yarn over the respective length of yarn to the longitudinal strip in frictional non-positive manner.

With this design of splice, the forces acting on the splice during the processing of the yarn are extended over a length of yarn which may be of corresponding length depending on the type and loading of the yarn, so that the splice is able permanently to withstand the forces occurring, in particular, during the further processing of the yarn. The length in question, therefore, may be, for example, of the order of magnitude of a few millimeters or more. Thus, with a resistant longitudinal strip adapted to the occurring forces, it is possible to ensure that the thus spliced yarn can be exposed to high tensile and frictional forces without the latter destroying or causing the longitudinal strip to tear. The longitudinal strip results in only a small increase in diameter at the place of the splice in comparison with the diameter of the yarn, because the two ends of yarn themselves are firmly held in a position pointing at each other in which there is no increase in diameter, i.e. especially in abutting manner with substantially transversely extending cut-off sections or with bevels at the end and at the start of the ends of yarn, which are able to overlap over the bevelled section without there being an overall increase in diameter. The thus produced splice is also characterized in that it contains no self-undoing forces.

The material of the longitudinal strip may be, in particular, known plastics, such as PVC or polyester, which, even when in the form of particularly thin longitudinal strips, are capable of withstanding high tensile and shearing forces, and this with a thickness of, for example, 0.05 mm.

The frictional non-positive connection between longitudinal strip and end of yarn is advantageously produced in that a bonding agent is used as the joining agent. Another likewise suitable joining agent is a thermoplastic. The aforementioned joining agents are ones which are applied to the respective longitudinal strip. In addition, it is also possible to make the longitudinal strip itself the joining agent in that a thermoplastic is used for the material of the longitudinal strip. In addition, it is possible for the joining agent to be in the form of a hook-and-pile fastener, wherein the surface of the longitudinal strip facing the yarn and the surface of the end of the yarn form those parts typical of a hook-and-pile fastener, namely the hook side and the pile side.

The splice between end of yarn and longitudinal strip may advantageously be of such design that the longitudinal strip encompasses the respective ends of the yarn. This results in a splice between longitudinal strip and end of yarn over a wide region of the circumference of the yarn and consequently in a particularly resistant splice. However, it is also possible to join the ends of yarn together using two opposing longitudinal strips, as a result of which the forces acting on the splice are transmitted to two longitudinal strips. In order to make the splice particularly intensive, the longitudinal strips are disposed in such a manner that they project away from the ends of yarn radially to the sides and are joined together in said region.

A further possibility for strengthening the splice consists in that the ends of yarn are held at a distance from each other and each end of yarn is held between two longitudinal strips, said longitudinal strips being joined together in the region between the ends of yarn. An especially strong splice is achieved in that the longitudinal strips themselves are joined together in the region between the ends of yarn.

If two longitudinal strips are used for attachment to each end of yarn, they can advantageously be overlappingly joined together at the sides, this resulting in an especially high degree of loadability in the region of the overlap, which overlap may be of sufficient length. Of course, possible for the longitudinal strips to be abuttingly joined together. With such a joint, however, it is necessary to use a joining agent of particular tensile strength at the joint, because the entire tensile load and therefore the stresses occurring in the splice are concentrated at that point.

A further possibility for producing the splice consists in joining together the two pairs of longitudinal strips by means of at least one further longitudinal strip. In this case, the aforementioned joint is covered by a further longitudinal strip covering the joint, this correspondingly strengthening the splice.

As described above with respect to its various embodiments, the splice is required in many different arrangements for the processing of a group of warp threads sup-plied, for example, to a weaving machine and transversely across such a group of warp threads. In this case, the splices may be juxtaposed. It is, however, also possible for the splices to be provided in staggered manner one behind the other, this being of advantage if particular importance is attached to the transverse dimensions of the group of warp threads in the region of the splices. In such a case, the staggered arrangement is of advantage.

DESCRIPTION OF THE DRAWINGS

Example embodiments of the invention are presented in the drawings, in which.

DETAILED DESCRIPTION

Figure 1:
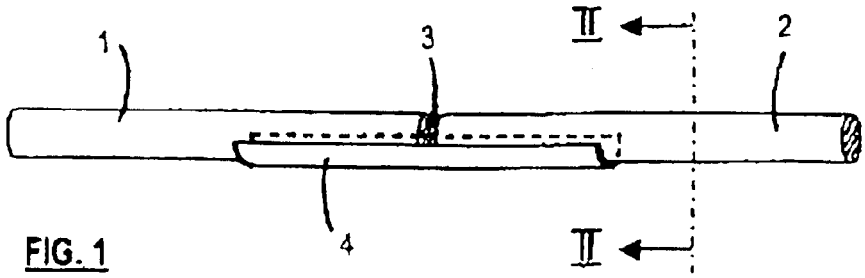
FIG. 1 shows a splice between two ends of yarn with one single longitudinal strip.

FIG. 1 shows a splice between two ends of yarn 1 and 2 positioned to point at each other. On their sides facing each other, the two ends of yarn 1 and 2 have substantially radial interfaces 3. The connection between the two ends of yarn 1 and 2 is established by the longitudinal strip 4, which is permanently joined to the two ends of yarn 1 and 2 by a frictional, non-positive connection by means of a bonding agent carried by the longitudinal strip 4. The longitudinal strip 4 is of a plastic material, a known thermoplastic being used as the bonding agent. Consequently, the longitudinal strips 4 effectively results in one continuous yarn which includes the two ends of yarn 1 and 2 and which has only a small increase in cross section in the region of the longitudinal strip 4, with the result that a thus spliced yarn can readily be further processed.

Figure 2:
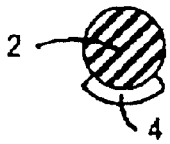
FIG. 2 shows a section through the arrangement according to FIG. 1 along the line II—II.

FIG. 2 shows a section along the line II—II in FIG. 1.

Figure 3:
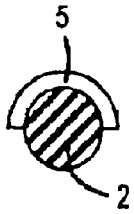
FIG. 3 shows a splice with a longitudinal strip partially encompassing one end of yarn, in section.

FIG. 3 shows a sectional representation of a modified version of a splice according to FIGS. 1 and 2. The splice in FIG. 3 comprises a longitudinal strip 5 which encompasses the end of yarn 2 virtually over an area of around 180° and which therefore provides a splice with particular load-bearing capacity.

Figure 4:
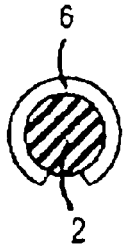
FIG. 4 shows a further variant with a longitudinal strip encompassing most of the end of yarn, in section.

FIG. 4 shows a splice in which a longitudinal strip virtually encompasses the entirety of the end of yarn 2. As can be seen, the longitudinal strip 6 in this case extends so far in the circumferential direction of the end of yarn 2 that only a narrow gap is left between the edges of the longitudinal strip 6.

Figure 5:
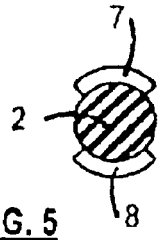
FIG. 5 shows a splice with two opposing longitudinal strips, in section.

FIG. 5 shows a splice in which two longitudinal strips 7 and 8 are used. The two longitudinal strips 7 and 8 are joined to the end of yarn 2 (and to the other end of yarn, not shown) by means of the two longitudinal strips 7 and 8, the two longitudinal strips each extending over only a relatively small part of the circumference of the end of yarn 2.

Figure 6:
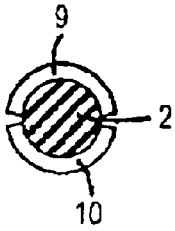
FIG. 6 shows a splice with two opposing longitudinal strips, each almost half-encompassing the end of yarn, in section.

According to FIG. 6, there are two longitudinal strips 9 and 10, which each encompass the end of yarn 2 almost to the same extent as shown with regard to a longitudinal strip in FIG. 3.

Figure 7:
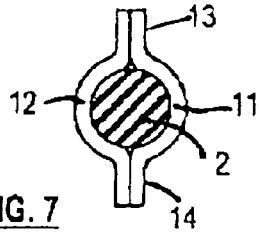
FIG. 7 shows a splice with two longitudinal strips, said longitudinal strips projecting laterally from the end of yarn and being joined together there.

FIG. 7 shows a splice which likewise comprises two longitudinal strips 11 and 12, which, however, project radially at the sides and thus form two wings 13, 14 in the region of which the longitudinal strips 11 and 12 are joined together. The splice in FIGS. 13 and 14 can in this case be made particularly intensive, with the result that this type of splice is particularly resistant to friction and tensile stresses.

Figure 8:
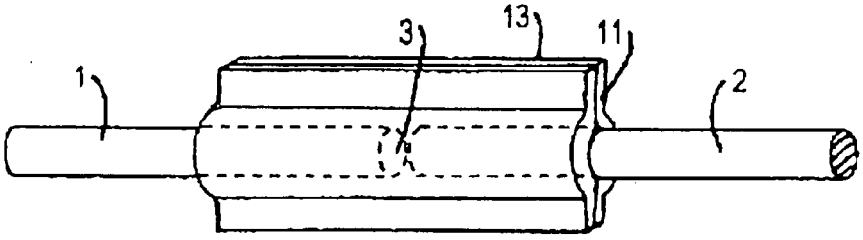
FIG. 8 shows a representation similar to that in FIG. 1, the underlying design being that according to FIG. 7 and the ends of yarn being cut off substantially transversely.

The representation in FIG. 8 is a side view of a splice according to FIG. 7, the latter being a sectional representation. It can clearly be seen from FIG. 8 how the facing sides of the ends of yarn 1 and 2 are formed, namely similarly to the embodiment shown in FIG. 1, by a substantially radial cut 3, which then exists, of course, on both ends of yarn 1 and 2.

Figure 9:
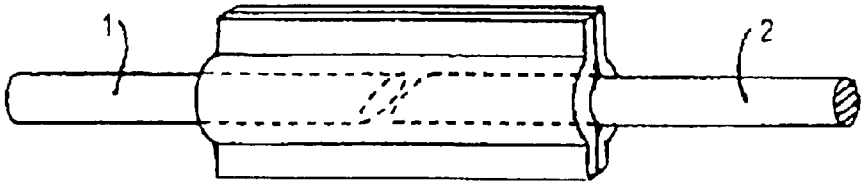
FIG. 9 shows a splice similar to that in FIG. 8, but with the ends of yarn cut off at an oblique angle.

With regard to the actual splice, FIG. 9 shows the same embodiment as in FIG. 8, but, in this case, there is a different design of the inner sides of the two ends of yarn 1 and 2, which, in this case, mutually overlap through being cut at an oblique angle.

The above-described embodiments are ones in which the longitudinal strip(s) which make the splice extend over the two ends of yarn 1 and 2, with the result that any occurring tensile forces are transmitted from one end of yarn, e.g. 1, to the respective longitudinal strip 11 or 12 and from there to the other end of yarn 2. However, it is also possible for the splice to be made in a different manner, namely in that the longitudinal strips are provided between the facing sides of the ends of yarn 1 and 2 with an overlapping or abutting joint, which then absorbs the occurring tensile forces.

Figure 10:
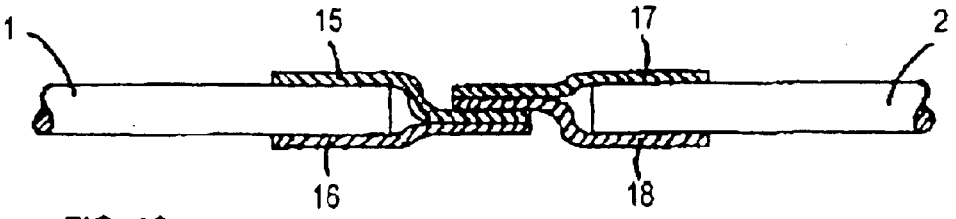
FIG. 10 shows a splice with overlapping longitudinal strips, said longitudinal strips being joined together by a frictional non-positive connection.

For this purpose, FIG. 10 shows an embodiment in which the two ends of yarn 1 and 2 are each joined by two longitudinal strips 15/16 and 17/18, the longitudinal strips 15/16 projecting into a space between the two ends of yarn 1 and 2 and overlapping in this region with the longitudinal strips 17 and 18. In the region of the overlap, the longitudinal strips 15/16 and 17/18 are firmly joined together, for example, by means of a bonding agent, this, therefore, establishing the splice between the two ends of yarn 1 and 2.

Figure 11:
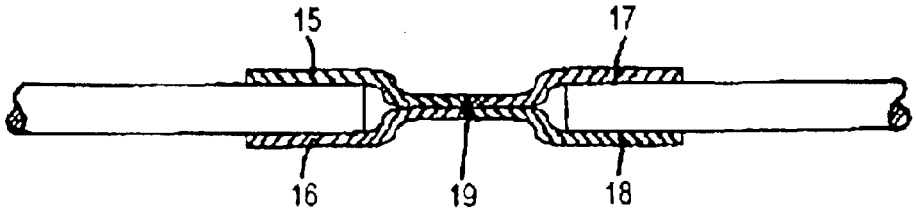
FIG. 11 shows a splice with two longitudinal strips for each end of yarn, the longitudinal strips of each end of yarn meeting each other in abutting manner.

A variation on the splice shown in FIG. 10 is presented in FIG. 11, in which the longitudinal strips 15/16 and 17/18 meet in abutting manner at the joint 19; which at the same time forms a bonded joint or welded joint. Given sufficient bonding power of the bonded joint or welded joint, this design is sufficiently resistant to tensile forces and friction.

Figure 12:
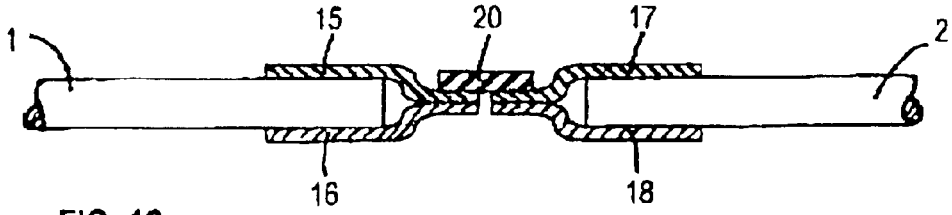
FIG. 12 shows a splice similar to that in FIG. 11, but with a further longitudinal strip making the spliced connection.

A further variation on the design shown in FIGS. 10 and 11 is presented in FIG. 12, in which the longitudinal strips 15/16 and 17/18 maintain a small distance from each other, said distance in this case being bridged by a further longitudinal strip 20. Said longitudinal strip 20 is glued on at the facing ends of the longitudinal strips 15/16 and 17/18 and thus forms the splice between the two ends of yarn 1 and 2.

Figure 13:
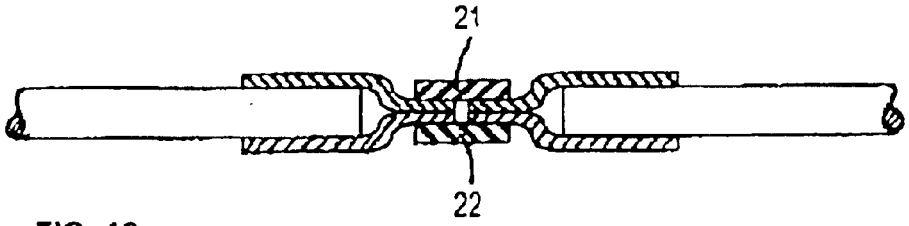
FIG. 13 shows a splice similar to that in FIG. 12, but with two additional longitudinal strips making the spliced connection.

A reinforced splice is shown in FIG. 13, in which, instead of just one longitudinal strip (the longitudinal strip 20 according to FIG. 12), a further longitudinal strip is provided, there namely being the two longitudinal strips 21 and 22, which are opposite each other and which hold together the ends of the pairs of longitudinal strips 15/16 and 17/18 by means of a bonded connection.

The making of splices between two ends of yarn is of particular importance in connection with the manufacture of textiles, especially in connection with the weaving of textiles, wherein groups of yarns are supplied to the corresponding processing machine. Using the presently conventional technique, this is done by removing the groups of yarns from warp beams onto which the individual yarns are wound side by side. In order not to interrupt the operation of the processing machine for an unnecessarily long period of time, as the warp beams come to the end the affected ends of yarn must be joined to the ends of yarn of a new warp beam, for which purpose it is necessary to join together a large number of yarns, namely up to several thousand yarns. This method of splicing is, therefore, a technique which represents an essential and technically complex step in the production of textiles. Owing to the considerable time required for making the splices, efforts are made to use warp beams which are as large as possible, which, however, makes it compulsory to produce correspondingly large lot sizes within which there is then correspondingly seldom the need to make a large number of splices. In the case of the production of standard goods, the large lot sizes generally represent no particularly great problem. If, however, the goods in question are fashion goods for which textiles in lengths of only a few 100 meters or less are required, the splicing of the yarns of the old and new warp beams and the presently therewith associated long downtime of the machine are associated with such great costs that the woven goods, produced on the basis of a small lot size, would be made considerably more expensive.

There is, therefore, the initially described problem of creating the possibility of making a splice which is especially able to withstand stresses, is easy to make and does not particularly disrupt the continuous operation of the machine during the production of textile goods.

The above-described designs of a splice between two ends of yarn are excellently suited for splicing the ends of the individual yarns of two groups of yarns prior to being supplied to a processing machine, such as a weaving machine. According to the below-described further invention, the process for making a splice in the aforementioned context is such that the ends of yarn of the two groups of yarns are deposited, positioned to point at each other in the same direction, on a transverse tape such that the ends of yarn of one group of yarns are opposite the ends of yarn of the other group of yarns, the transverse tape extending transversely with respect to the groups of yarns across same in the region of the ends of yarn to be joined, whereupon the ends of yarn are joined to the transverse tape and therefore to each other through activation of a joining agent carried by the transverse tape, whereafter the transverse tape is divided, by a cutter extending along the ends of yarn and therebetween, into individual splices each with a longitudinal strip, this resulting in each case in a continuous individual yarn with the inclusion of the splice. This process permits the fast making of a multiplicity of substantially juxtaposed splices on the basis of two groups of yarns. The process is easy to perform and therefore makes it possible, also in the case of small lot sizes, to make the necessary splices between the ends of yarn without this representing a factor which makes the end product particularly more expensive.

Making the splices by means of a transverse tape already provides a solid splice or join. However, it is also possible to improve the quality of the splice, namely by using two transverse tapes, wherein an opposing transverse tape is laid on the ends of yarn deposited on the first transverse tape, said opposing transverse tape likewise being joined to the ends of yarn through activation of a joining agent, whereupon the cutter divides both transverse tapes into two longitudinal strips with a splice for each end of yarn.

Figure 14:
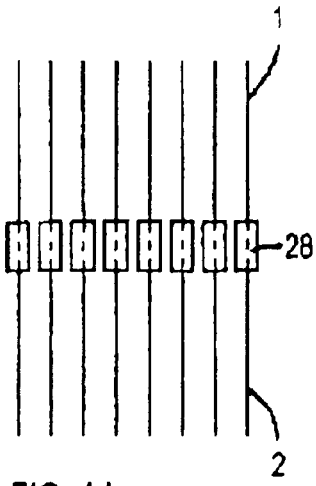
FIG. 14 shows a top view of a group of yarns with juxtaposed splices.
Figure 15:
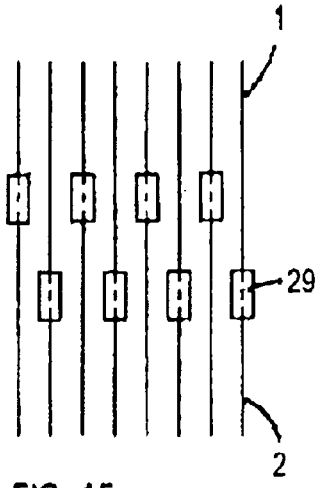
FIG. 15 shows a group of yarns with staggered splices disposed one behind the other, arranged in two rows of splices.
Figure 16:
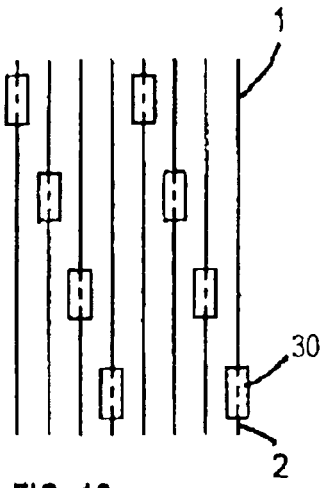
FIG. 16 shows an arrangement similar to that in FIG. 15, but with four rows of staggered splices disposed one behind the other.

With this process for splicing the ends of the individual yarns of two groups of yarns, it is possible to proceed in a variety of manners. Thus, it is possible, as shown in FIG. 14, to dispose the splices 28 within a group of yarns directly next to each other. Alternatively, however, it is possible for the splices of the ends of yarn 1 and 2 to be disposed in staggered manner one behind the other, as presented in FIGS. 15 and 16 with respect to the splices 29 and 30. FIG. 15 shows two rows of splices within which the splices are disposed in staggered manner one behind the other; and FIG. 16 shows splices 30 which are arranged in four rows, the splices being disposed in staggered manner one behind the other from end of yarn to end of yarn.

Figure 17:
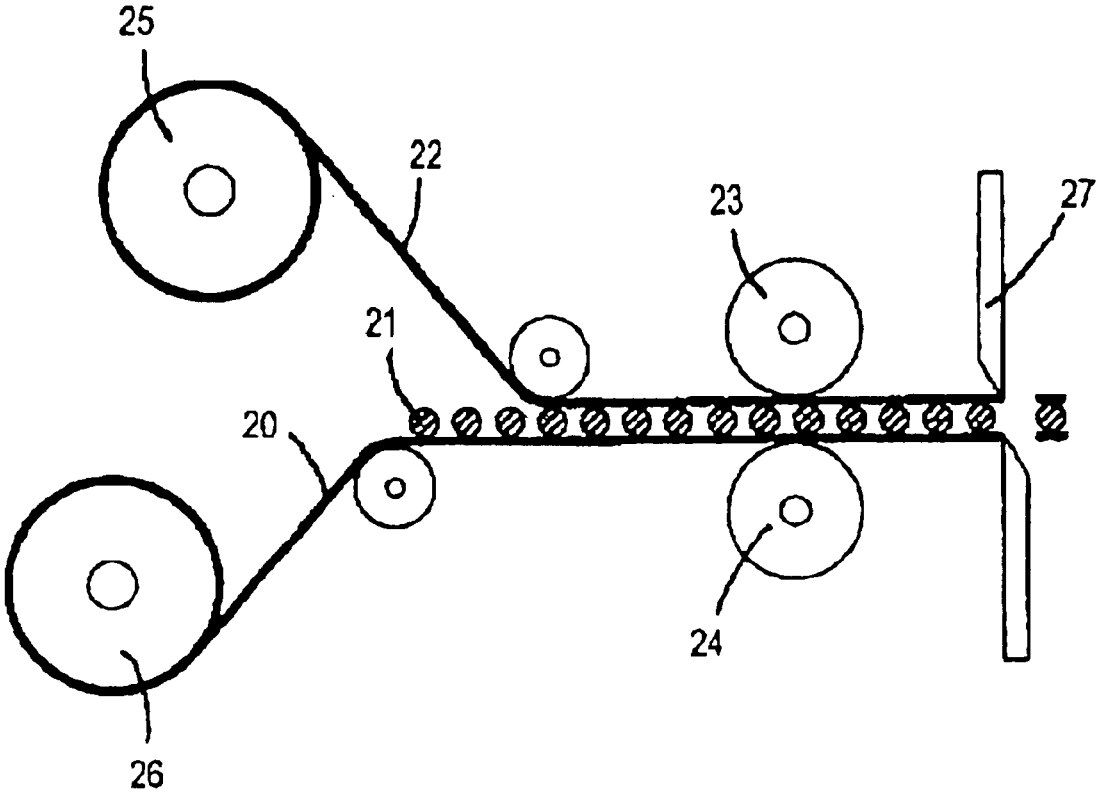
FIG. 17 shows a basic representation of a device for making the splices for a group of yarns.

FIG. 17 shows a basic representation of a device with which the ends of individual yarns of two groups of yarns are joined together. This is based on a process in which the ends of yarn 21 are deposited on a transverse tape 20, the ends of yarn 21 being covered by a further transverse tape, namely the opposing transverse tape 22, and both transverse tapes 20 and 22 being joined to the ends of yarn 21 through activation of a joining agent carried by the transverse tapes 20 and 22. The joining agent in this case is, for example, a cold-bonding agent. The transverse tapes 20 and 22 thus joined to the ends of yarn 21 are then directed through pressing rollers 23 and 24, which bring about the intimate joining of the said three components 20, 21 and 22. At the same time, the thus produced compound unit of the groups of yarns is further transported, the pressing rollers 23 and 24 drawing said compound unit from the supply rollers 25 and 26, onto which the two transverse tapes 20 and 22 are wound.

After leaving the two pressing rollers 23 and 24, the groups of yarns, firmly held between the two transverse tapes 20 and 22, enter the region of the cutter 27, which cuts through the individual transverse tapes along the ends of the yarns, this resulting, for each end of yarn, in two longitudinal strips as described hereinbefore, said longitudinal strips then giving rise to a continuous individual yarn including the splice which contains them. The device therefore provides continuous individual yarns each with a splice of the above-described kind.

The placing of the ends of yarn in a position in which they can be brought into relation for splicing is described in the aforementioned EP 0 989 218 A1 (see therein, in particular, FIG. 6 to 7). The placing of the ends of yarn in a position in is which they can be spliced together in the sense of the above-presented invention is, therefore, of itself known.

What is claimed is:

1. A splice between two adjacent cut ends of yarn, wherein the cut ends of two lengths of yarn are positioned substantially coaxially and adjacent each other, and are each joined over a length of yarn to at least one longitudinal strip, said longitudinal strip having on its side facing the external longitudinal surfaces of said two lengths of yarn joining agent, said joining agent permanently binding those two lengths of yarn to the longitudinal strip without integrally connecting the adjacent cut ends.

2. Splice according to claim 1, characterized in that the joining agent is a bonding agent.

3. Splice according to claim 1, characterized in that the joining agent is a thermoplastic.

4. Splice according to claim 3, characterized in that the longitudinal strip forms the joining agent.

5. Splice according to claim 1, characterized in that the longitudinal strip and the surface of the yarn comprise a joining agent in the form of a hook-and-pile fastener.

6. A splice according to claim 1, wherein the adjacent cut ends of yarn are bevelled and the bevelled sections overlappingly point at each other.

7. Splice according to claim 1, characterized in that the longitudinal strip (5, 6) is wrapped around the outer circumference of the yarn.

8. Splice according to claim 1, wherein the longitudinal step comprises two opposing longitudinal strips.

9. Splice according to claim 8, characterized in that the ends of the longitudinal strips project radially away from the yarn and are joined together.

10. Splice according to claim 1, wherein the adjacent cut ends of yarn are spaced apart.

11. Splice according to claim 10, characterized in that the longitudinal strips are overlappingly joined together at the sides.

12. Splice according to claim 10, characterized in that the longitudinal strips are abuttingly joined together at the sides.

13. Splice according to claim 10, characterized in that the longitudinal strips are joined together by at least one further longitudinal strip.

* * * * *